United States Patent [19]

Gudgel

[11] 4,453,884

[45] Jun. 12, 1984

[54] HOOK ROTATING MECHANISM

[75] Inventor: Howard S. Gudgel, Tulsa, Okla.

[73] Assignee: Zena Equipment, Inc., Tulsa, Okla.

[21] Appl. No.: 410,088

[22] Filed: Aug. 20, 1982

[51] Int. Cl.[3] ..... F16L 3/10

[52] U.S. Cl. ..... 414/745; 175/52; 294/90; 414/22

[58] Field of Search ..... 414/745, 748, 910, 22; 175/52, 85; 211/605; 294/102 A, 90 X

[56] References Cited

U.S. PATENT DOCUMENTS 3,526,425 9/1970 Langowski et al. ..... 414/22 X 3,633,767 1/1972 Mitchell et al. ..... 414/22

3,695,669 10/1972 Langowski ..... 294/90 X 4,326,745 4/1982 Guier ..... 294/90

*Primary Examiner*—Robert J. Spar

*Assistant Examiner*—Janice Krizek

*Attorney, Agent, or Firm*—Head, Johnson & Stevenson

[57] ABSTRACT

In a drilling system in which the hook is guided for vertical travel, by a pair of guide cables supported in the tower, so as to be in a given azimuth while handling drill pipe in the hole, an improvement in the hook mechanism which provides for rotating the hook through a selected angle with respect to the travelling block, as an aid to stacking the stands of drill pipe in the tower during the process of coming out of the hole, and vice versa.

4 Claims, 8 Drawing Figures

Fig. 5

HOOK ROTATING MECHANISM

CROSS-REFERENCE TO RELATED APPLICATION

This application is related to my copending application Ser. No. 241,508, entitled "Elevator Transfer and Support System" which is entered into and made part of this application by reference.

BACKGROUND OF THE INVENTION

1. Field of the Invention

This invention lies in the field of rotary drilling systems. More particulary, it is concerned with a type of automatic drilling system in which the traveling block and hook are supported and guided for motion along the axis of the rotary table by means of two guide cables, in tension, supported from the tower. Such a system is described in my copending application Ser. No. 241,508.

2. Description of the Prior Art

In the prior art it is customary to support the traveling block directly from the crown block, so that it nominally hangs on the axis of the rotary table. However, it is possible by applying lateral forces to the hook, or to a stand of pipe hanging from the hook, to move the hook in a direction lateral to the vertical travel axis.

In the system utilizing two elevators and using automatic means for disconnecting the hook from the elevators, etc., it is necessary to guide the vertical motion of the hook by means of guide cables. This prevents any lateral movement of the hook from the axis of the rotary table.

At the fourbleboard, which stands some 90 feet above the floor of the drilling platform, there is a pipe rack with a number of parallel fingers spaced apart a sufficient distance so that pipe, while standing on the floor, can be guided into one of these slots where it will be securely held. Because of the limited horizontal space that high in the tower, the fourbleboard is generally in the plane of the hook. Therefore, in removing a stand of pipe from the elevator to push it into one or another of the spaces or slots between the fingers, the hook must be turned a small angle of the order of 30°, so that the pipe will move directly into space between the fourbleboard and the fingerboard, or pipe rack. This is generally done manually by the tower man, standing on the fourbleboard, and is a very dangerous occupation. By the use of this improvement it now becomes possible to substantially automatically direct the pipe into the fingerboard with less physical danger to the tower man.

SUMMARY OF THE INVENTION

It is a primary object of this invention, in an automatic drilling system such as the art to which this invention pertains, to provide a power drive means for rotating the hook through a selected small angle while it is supporting a stand of pipe into the tower.

These and other objects are realized and the limitations of the prior art are overcome in this invention by providing a lifting mechanism comprising the traveling block and the body of the hook, integral with each other, and the hook suspended from the body, on a thrust bearing, so that it can be rotated with respect to the body of the hook through a selected angle. The body of the hook and the traveling block are guided by means of a pair of guide cables, in tension, hanging from the tower, which are positioned in a selected position with respect to the rotary table, so as to keep the lifting mechanism along the axis of the rotary table as it travels up and down the tower. It will be clear, of course, that with these guide cables it is impossible to move the body and traveling block laterally with respect to the axis of the rotary table, and it is also impossible to rotate the hook body with respect to the axis of the rotary table.

In the method of stacking the stands of drill pipe as they are broken out of the drill string, while coming out of the hole, these stands of pipe must be lifted out of the tool joint and moved laterally to a position on the derrick floor, such that when the upper end of the pipe is removed from the elevator by the derrick, or tower man standing on the fourbleboard, it can be easily slid into one of the slots between a pair of fingers on the pipe rack. The fourbleboard is generally in a line with the rotary table. Thus, when a stand of pipe is to be removed from the elevator it has to be handled through a devious path to get from the elevator into one of the slots between the fingers.

In order to aid this type of pipe handling, the hook is separately supported in the body so as to rotate about the axis of the body. A rotary mechanism is provided having two mutually rotatable parts. One part is attached to the body, and the other part to the hook, so that by the use of a power means to rotate this mechanism, the hook can be rotated through a selected angle.

This rotating mechanism is only used while there is a single stand of pipe hanging in the elevator. With this relatively light load on the hook, the elevator can be rotated to the desired angle so that the pipe can be removed or inserted. As the hook and elevator are lowered to pick up another stand of pipe, the elevator again resumes its original azimuth.

BRIEF DESCRIPTION OF THE DRAWINGS

These and other objects and advantages of this invention, and a better understanding of the principles and details of the invention, will be evident from the following description taken in conjunction with the appended drawings, in which.

DESCRIPTION OF THE PREFERRED EMBODIMENT

Figures 1, 7:
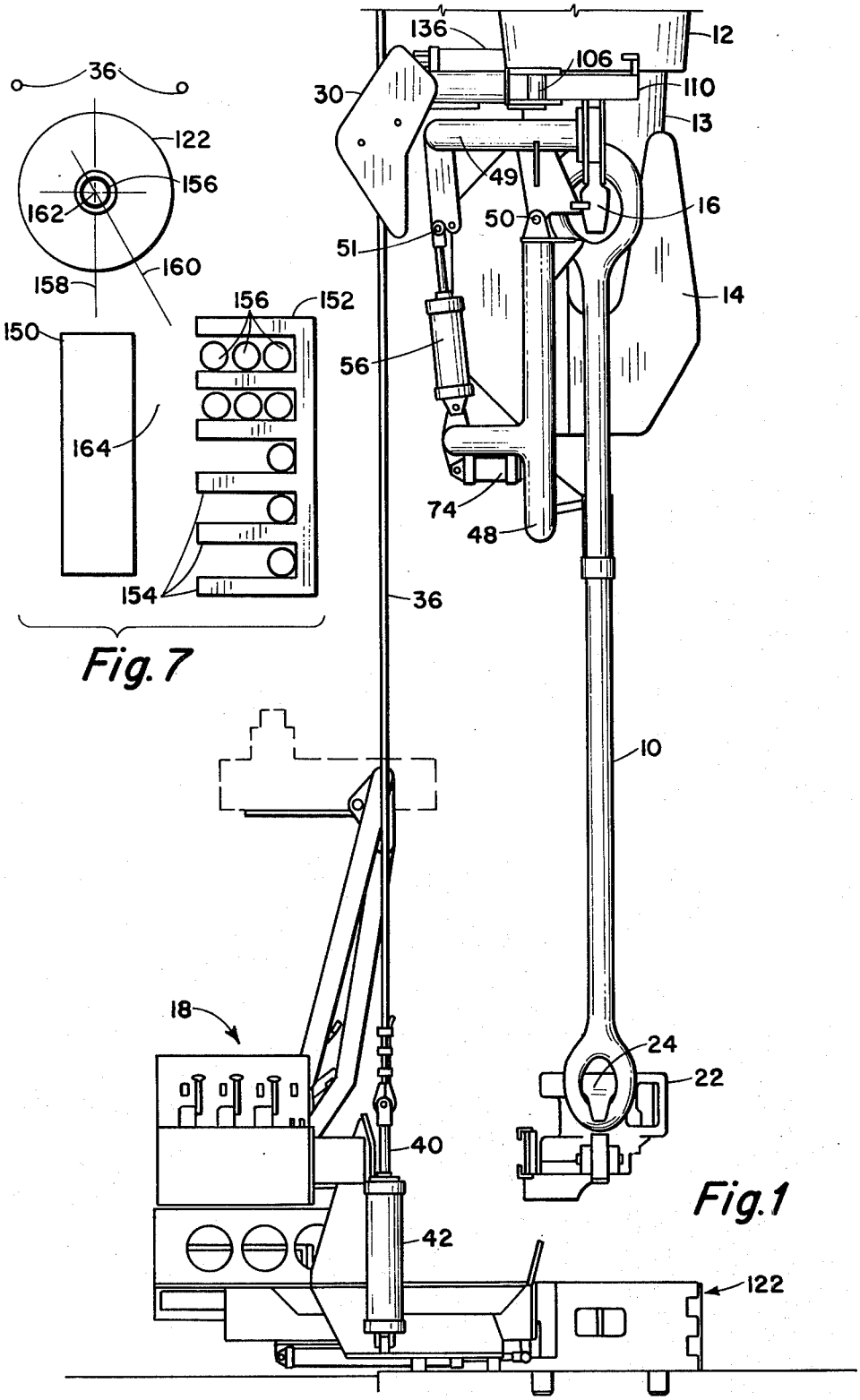
FIGS. 1 and 2 represent a side elevation and front elevation respectively of the lifting means, comprising the body and hook, the guide cables, and the lifting links which support the elevator.
FIG. 7 illustrates schematically a view of a fourbleboard and pipe rack which are supported in the tower at approximately 90 feet above the floor.
Figure 2:
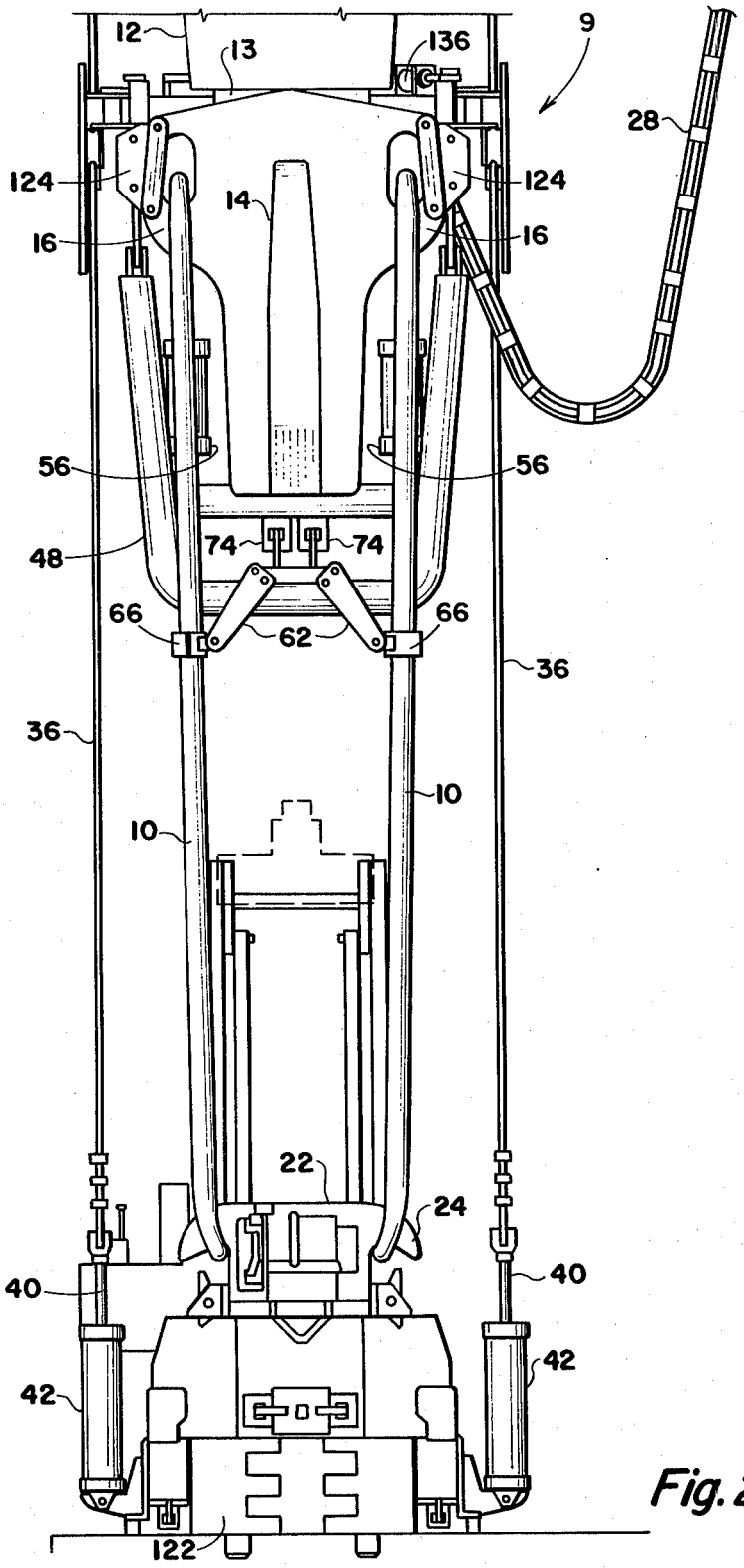

Referring now to the drawings and in particular to FIGS. 1 and 2, there are shown two views of the hook mechanism 9, the guide cables 36 and the link mechanism 10, for supporting the elevator 22 by means of the ears 24 on either side of the elevator. The rotary table 122 is shown in position coaxial with the hook 14 and the elevator 22. The mechanism indicated generally by the numeral 18 is an elevator transfer and support system, which is fully described in my copending application Ser. No. 241,508, and will not be described further in great detail.

In FIGS. 1 and 2 the upper part of the hook body 12 (partially shown), and the traveling block (not shown) which are conventional are well known in the art. The hook 14 has an axial portion 13 which is suspended in the body 12 on thrust bearings (not shown) in a conventional manner.

The rotating mechanism 110, 136, etc., will be described fully in connection with FIGS. 5 and 6, at which time reference will be made back to FIGS. 1 and 2, and also to FIGS. 3 and 4.

The elevator 22 is supported by the pair of links 10 which support the elevator by means of ears 24 one on each side. This is shown more clearly in FIG. 2. The links are supported from the hook by means of two ears 16.

These are fully described in the copending application No. 241,508, which is entered into this application by reference. However, for convenience in understanding how the drilling apparatus works the mechanism will be briefly described as follows. There is a U-shaped bracket 49 attached to the hook in the position of the ears 16. There is another U-shaped yoke 48 suspended in bearings 50. The yoke 48 is attached to the links by means of a pair 74 of pressurized fluid cylinders and pistons.

Figure 3:
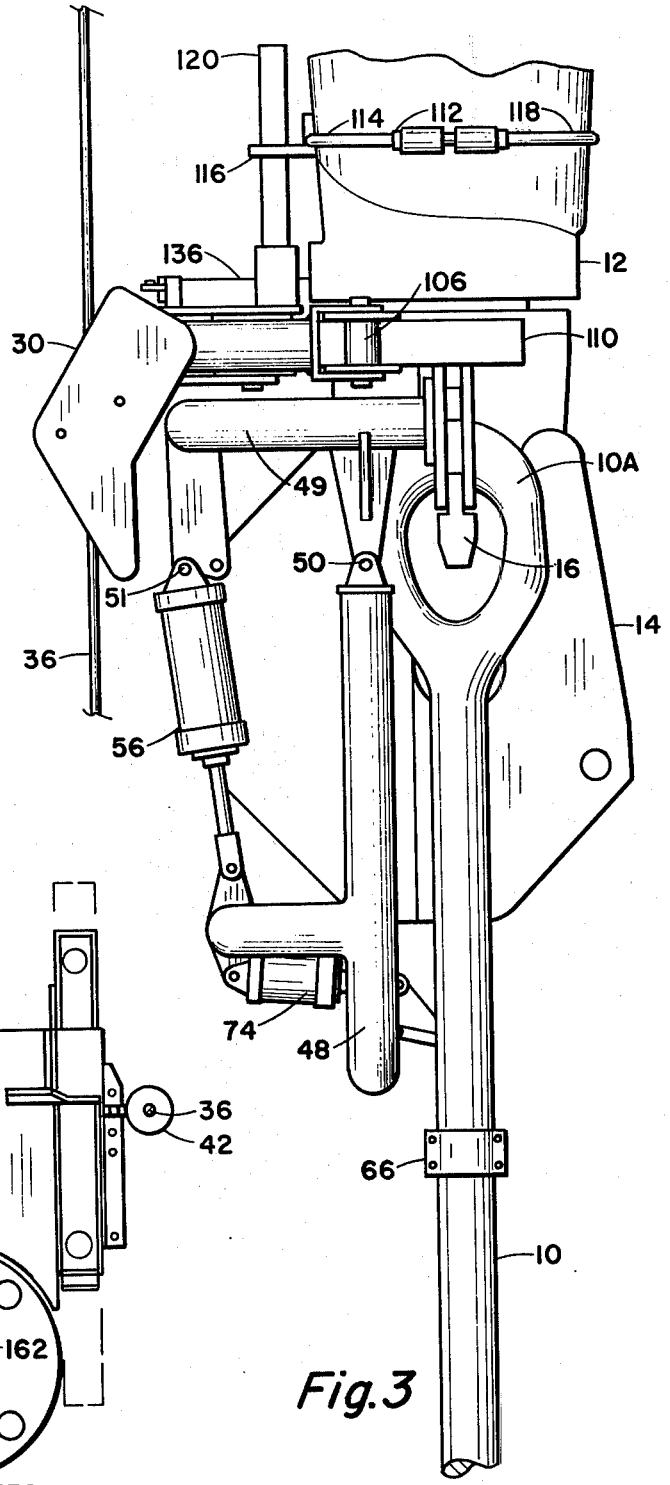
FIGS. 3 and 4 illustrate to larger scale the upper portions of FIGS. 1 and 2 respectively, showing details of the hook rotating mechanism.
Figure 4:
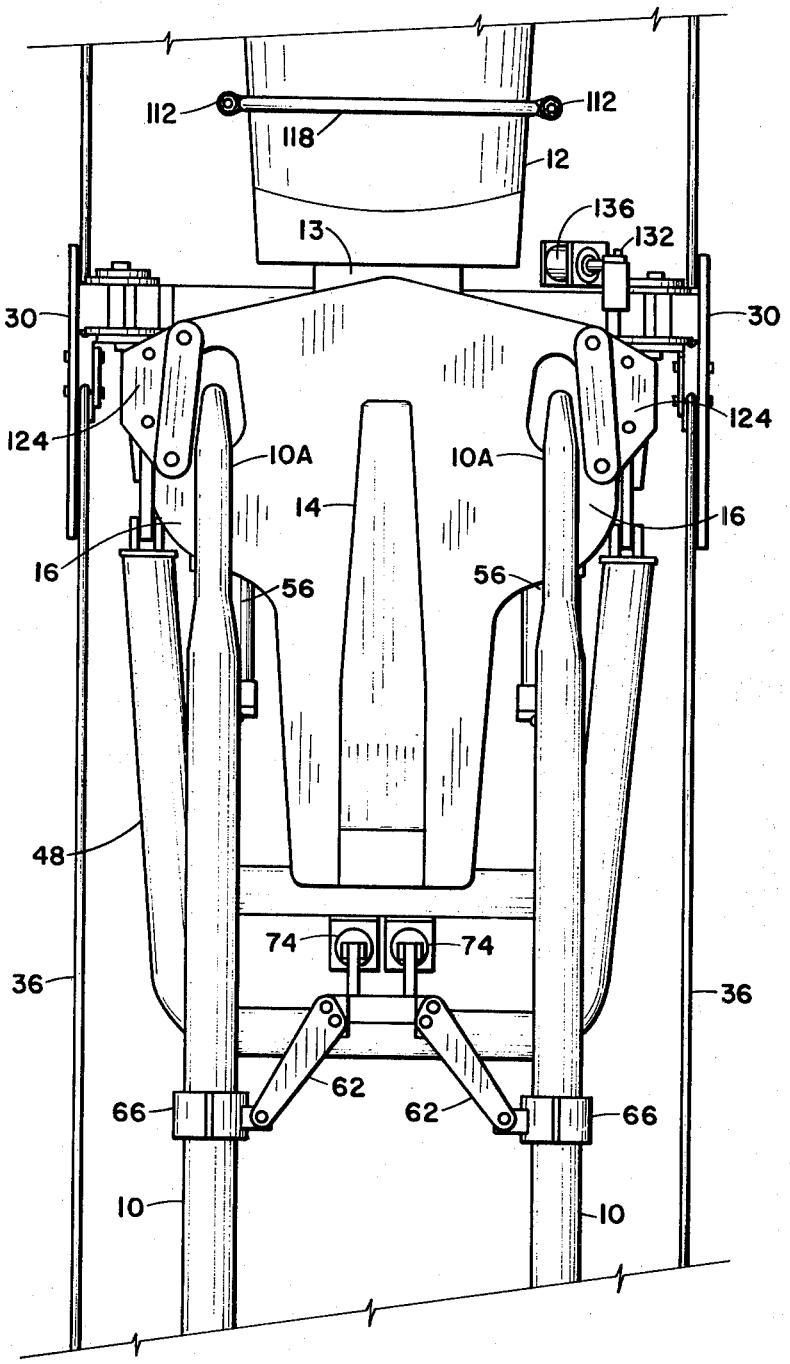

As is shown more clearly in FIGS. 3 and 4, this mechanism is attached to the brackets 62 and 66. Pressurized fluid cylinders 56 are provided to rotate the bracket 48 and with it the link 10. Also the links 10 can be spread apart by the mechanism 74, 62, 66. Thus the elevator can be lowered to rest on the platform 18 and the links spread so as to be unhooked from the ears 24 of the elevator or can be reapplied to the ears 24 as may be necessary. This mechanism obviates the need of a man to handle the links, and hook them to the elevators, since it is all done automatically, and more rapidly and safely.

It will be clear, however, in this type of handling of the elevators on top of the rotary table 122, and stored on the platform 18 behind the rotary table, the hook must be in a specific position which is directly above the axis of the rotary table end with a certain orientation. To ensure that the hook is always in the proper position, a pair of guide cables 36 are attached to the piston rods 40 and cylinders 42 with high pressure fluid, so that the cables can be applied under tension to maintain a "vertical track" over which the hook travels in going from the derrick floor up into the tower. Item 28 of FIG. 2 represents the hoses for handling the pressurized fluid for the cylinders 74 and 56.

Figure 8:
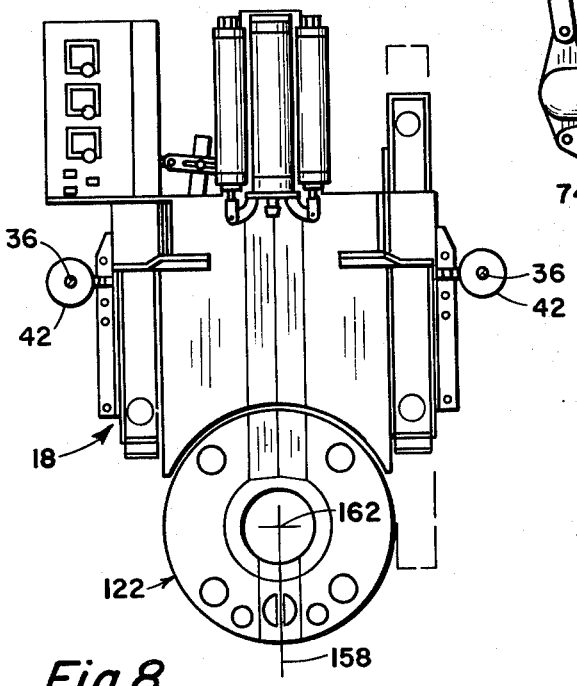
FIG. 8 illustrates a view of the rotary table, the guide cables and the mechanism which is utilized to handle the elevator on the derrick floor.

FIG. 8 shows the relative position of the guide cables 36 and the cylinders 42 with respect to the rotary table 122, and the elevator support platform 18.

Referring for a moment to FIG. 7 there is shown a vertical view from above the fourbleboard 150 which is mounted approximately 90 feet above the derrick floor. It is positioned close to the vertical axis of the rotary table and is adjacent a pipe rack or fingerboard 152. The fingerboard 152 is shown on one side of the fourbleboard 150, however, in actual practice, another fingerboard (not shown) is positioned on the other side of the fourbleboard. The fingers 154 provide slots in between, of sufficient size to permit free access to the pipes that are stacked in the fingerboard, which are shown schematically as 156 in FIG. 7.

The fourbleboard is generally positioned along axis 158 of the rotary table. The opening 164 between the fourbleboard 150 and the fingerboard 152 is not in a direct line 158 from the rotary table with reference to the guide cables 136. It will be clear that if the hook 14 and the door in the elevator 22 can have their access in accordance with the line 160, then the pipe can be moved out of the elevator and into the space 164 directly, and then into any one of the slots for the stacking of the pipe 156.

Referring now to FIGS. 3, 4,5 and 6, the rotating mechanism 100 by means of which the hook 14 is rotated with respect to the hook body 12 will be fully described. The two guide cables 36 are shown in position with respect to the rotary table. There is a mechanism indicated generally by the numeral 100 which provides a U-shaped structure 102, 104 carrying a plurality of rollers 106 and 108. These rollers are in such a position that they conform to the semi-circular track 110. Two of the rollers 106 are mounted on the outside and are spaced apart, from each other, while the third roller 108 is on the inside of the track. Thus the three of them together guide the mechanism 102 with respect to the track 110. The track 110 is supported at each end in the mechanism 124 which comprises the attachment to the hook. The track 110 is mounted concentric with the axis 162 of the hook. By placing the cylinder 136 on the other side of 102 in pin holes 128A and 132A, the cylinder 136 and piston rod 130 may be disconnected from the position shown in FIGS. 5 and 6, and affixed to the points 128A and 132A to enable pipe to be expeditiously loaded and unloaded from the other side of the fourbleboard, provided the hook can be rotated in the opposite direction when one side of the fingerboard is full to enable the tower man standing on fourbleboard 150 (See FIG. 7) to use the other side.

The body of the hook has a clamp ring comprising two parts 114 and 118 which are bolted together by means 112. The portion 114 has a horizontal portion 116 which has a slot 122 in which is positioned a vertical rod 120 which is attached to the bracket 109 which is part of the frame 102. Thus, the hook body is restrained from turning by means of the slot 122 and the rod 120. Rod 120 is part of the frame 102, which is attached by means of rollers 134 in the mechanism 30, which guides the frame 102 with respect to the vertical guide cables 36.

Figure 5:
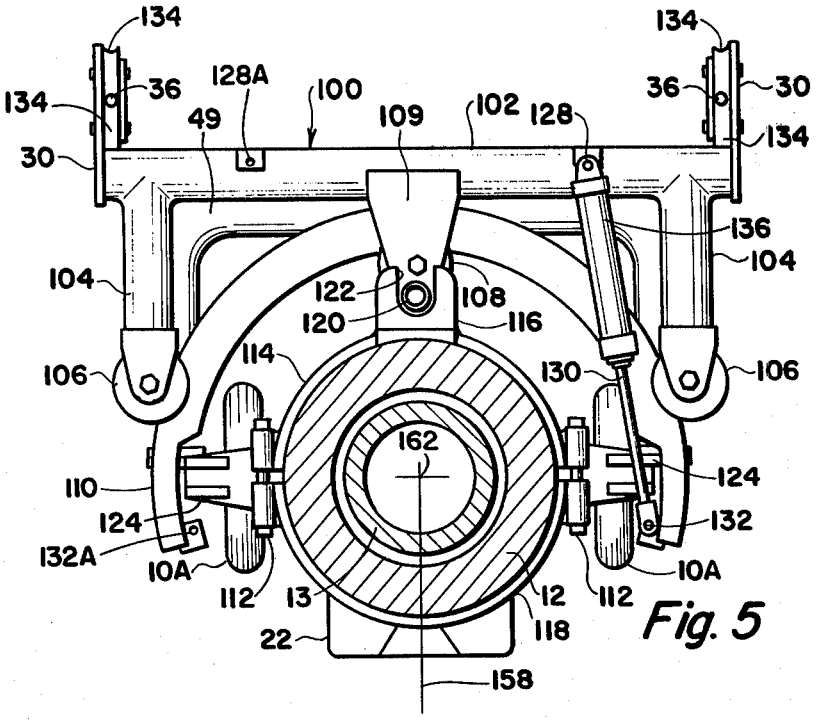
FIGS. 5 and 6 show in plan view the hook, guide cable and rotating mechanism which rotates the hook with respect to the guide cables.
Figure 6:
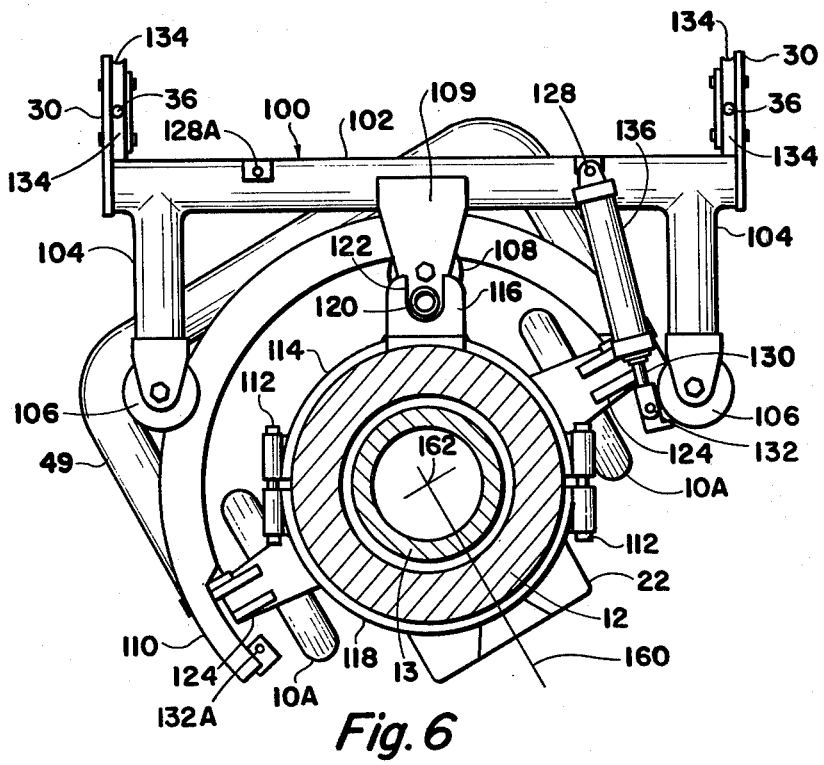

The rotary drive mechanism thus has two parts, one 110 can be called a track, which in the illustrations of FIGS. 5 and 6 is attached to the hook, and another mechanism 102 which can be called a trolley, which, by means of three rollers 106, 108 guides the rotation of the track with respect to the guide cables 36.

The two parts, namely the track and the trolley form a rotation control mechanism. While I have shown that the trolley is attached to and guided by the cables 36 while the track is attached to the hook, it will be clear that the mechanism can be designed so that the track is attached to the hook body and the guide cables, while the trolley could be attached to the hook. Also, the specific type of mechanism, such as the track and trolley is shown as one embodiment without limitation, since there are many other rotation control mechanisms that could be used to guide the rotation of the hook with respect to the hook body.

The track 110 and trolley 102 are relatively rotated by a pressurized fluid cylinder 136 and piston rod 130, one end attached to the trolley at point 128, and the other end attached to the track at point 132. It will be clear that when the piston is driven from the outer end, with the piston rod exposed, to the opposite end where the piston rod is inside of the cylinder, that the track will rotate with respect to the trolley, and with it, the hook will rotate through the same angle. For convenience, that angle has been shown to be 30° but any desired angle, of course, can be used. There are many types of drives, such as pneumatic motor, electrical motor, that could be used in conjunction with gears or chains to rotate the hook with respect to the hook body.

What has been described is an automatic drilling system which utilized a pair of elevators and an automatic means is provided for attaching the lifting means, by means of links to the elevators, and guiding the lifting means along a pair of stretched cables, so as to guide the movement of the lifting means vertically along the axis of the rotary table. Because of the rigidity of the lateral control of the lifting means by the guide cables, it becomes desirable to automate the rotation of the hook through a selected angle so as to make easier the work of the tower man in removing stands of pipe from the elevator, or for engaging a stand of pipe into the elevator, as is required in the process of coming out of, or going into, the bore hole.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

I claim:

1. For use in a rotary drilling apparatus having a rotary table and a pair of spaced vertical guide cables, an improved lifting means comprising:

a hook body;

guide means attached to said hook body cooperating with the guide cables to maintain said hook body directly above the axis of said rotary table as it travels vertically, and to maintain a fixed azimuth;

hook means supported by said hook body and rotatable about a vertical axis with respect to said hook body;

rotatable coupling means having two relatively rotatable parts, a first part attached to said hook means, the second part attached to said guide means and said hook body; and drive means between said first and second parts of said coupling means to rotate said hook with respect to said hook body through a selected angle.

2. The apparatus as in claim 1 in which said rotatable coupling means comprises:

(a) circular track means;

(b) trolley means having a plurality of spaced roller means adapted to roll around said circular track means, one of said track means and said trolley means being attached to said hook means, the other being attached to said guide means and said body means.

3. The apparatus as in claim 2 in which said plurality of roller means comprises at least three rollers, a first of said rollers being on one side of said track means, and the other two rollers being spaced on opposite sides of said first roller, and on the other side of the track means.

4. The apparatus as in claim 2 in which said drive means comprises piston cylinder means driven by pressurized fluid, said piston being attached to one of said trolley and said track, said cylinder being attached to the other of said trolley and said track.

* * * * *